US012678660B2

(12) United States Patent
Hu

(10) Patent No.: US 12,678,660 B2
(45) Date of Patent: Jul. 14, 2026

(54) DOUBLE-SIDED TREADMILL

(71) Applicant: Yongkang Saihan Electronic Technology Co Ltd., Jinhua (CN)

(72) Inventor: Jiachen Hu, Jinhua (CN)

(73) Assignee: Yongkang Saihan Electronic Technology Co Ltd., Jinhua (CN)

( * ) Notice: Subject to any disclaimer, the term of this patent is extended or adjusted under 35 U.S.C. 154(b) by 72 days.

(21) Appl. No.: 18/814,358

(22) Filed: Aug. 23, 2024

(65) Prior Publication Data

US 2026/0007924 A1 Jan. 8, 2026

(30) Foreign Application Priority Data

Jul. 7, 2024 (CN) ..... 202421590732.6

(51) Int. Cl.
*A63B 22/02* (2006.01)
*A63B 22/00* (2006.01)
*A63B 24/00* (2006.01)

(52) U.S. Cl.
CPC ..... *A63B 22/0235* (2013.01); *A63B 22/0046* (2013.01); *A63B 24/0087* (2013.01)

(58) Field of Classification Search
CPC . A63B 22/0046; A63B 22/02; A63B 22/0235; A63B 22/025; A63B 22/0285; A63B 23/04; A63B 24/00; A63B 24/0087; A63B 69/0028; A63B 2022/0278; A63B 2024/0093; A61H 2201/1685
See application file for complete search history.

(56) References Cited

U.S. PATENT DOCUMENTS 6,663,540 B1 * 12/2003 Huang ..... A63B 22/0214 601/126
9,039,579 B1 * 5/2015 Osime ..... A63B 22/14 482/54
2008/0176719 A1 * 7/2008 To ..... A63B 22/0235 482/54
2026/0021344 A1 * 1/2026 Ren ..... A63B 22/02

FOREIGN PATENT DOCUMENTS

CN 210278098 U * 4/2020

OTHER PUBLICATIONS

CN 210278098 English Translation (Year: 2020).*

* cited by examiner

*Primary Examiner* — Joshua Lee

(57) ABSTRACT

A double-sided treadmill includes a frame, a first running plate as a first movement side of a treadmill platform, a second running plate as a second movement side of the treadmill platform, and a control unit. When the treadmill is flipped over, the control unit controls a motor of the treadmill to change a driving direction, keeping a running belt always moving in a rearward direction of the treadmill. The treadmill of the present application can be used on two sides, with one side having a massage function and the other side having no massage functions, and different functions can be realized by flipping the treadmill over.

10 Claims, 3 Drawing Sheets

DOUBLE-SIDED TREADMILL

CROSS-REFERENCE TO RELATED APPLICATION

This application claims priority of Chinese Patent Application No. 202421590732.6, filed on Jul. 7, 2024, the entire contents of which are incorporated herein by reference.

TECHNICAL FIELD

The present application relates to the technical field of treadmills, and in particular to a double-sided treadmill.

BACKGROUND

Treadmill is a relatively common fitness equipment. The existing treadmill, which can usually only be used on one side, with a single function, is typically divided into treadmill with a massage part, such as a treadmill disclosed in the applicant's earlier patent with the number of 2024207633127, and treadmill without a massage part, such as a treadmill disclosed in the applicant's earlier patent with the number of CN220443112U.

In the actual use by users, the massage part is not applicable to all running states. The treadmill with the massage part is suitable for low-speed walking movement, helps to alleviate foot fatigue, with a high comfort level, while the treadmill without massage part is suitable for high and low-speed running movement. The existing treadmill cannot satisfy the two needs at the same time, and accordingly the improvement is made.

SUMMARY

In response to the deficiencies existing in the prior art, the present application provides a double-sided treadmill.

To solve the above technical problems, the present application provides the following technical solutions.

A double-sided treadmill includes:

a frame, a driving roller and a driven roller being rotatably arranged on the frame, the driving roller being driven to rotate by a motor arranged on the frame, and a running belt being wound around the driving roller and the driven roller;

a first running plate, arranged on the frame and surrounded by the running belt in a winding manner to serve as a first movement side of a treadmill platform;

a second running plate, arranged on the frame and surrounded by the running belt in a winding manner to serve as a second movement side of the treadmill platform; and a control unit, arranged on the frame or on a component mounted on the frame to serve for identifying front and back side states of a treadmill and for controlling forward and reverse rotation of the motor, the control unit controlling the motor to change a driving direction when the treadmill is flipped over, to keep the running belt always moving in a rearward direction of the treadmill.

In the above solution, preferably, the control unit includes a controller electrically connected to the motor and a first switch and a second switch electrically connected to the controller, the first switch being configured to identify the front and back side states of the treadmill, and the second switch being configured to control the forward and reverse rotation of the motor.

In the above solution, preferably, the first switch is a mercury switch or a gyroscope, and the second switch is a reversing switch.

In the above solution, preferably, a gap is left between the first running plate and the second running plate.

In the above solution, preferably, a transverse rod fixedly arranged on the frame is arranged at the gap.

In the above solution, preferably, both the first running plate and the second running plate are fixedly arranged on the frame.

In the above solution, preferably, a massage unit for massage is arranged on the second running plate.

In the above solution, preferably, the massage unit includes a plate member fixedly arranged on the second running plate and a plurality of projections distributed on the plate member.

In the above solution, preferably, the projections are integrally formed on the plate member.

In the above solution, preferably, the massage unit is a roller embedded in the second running plate and rotatably connected to the second running plate or the frame.

The present application has the following beneficial effects.

The treadmill of the present application with a simple structure and easy operation can be used on two sides, with one side having a massage function, and the other side having no massage functions, and different functions can be realized by flipping the treadmill over to meet two needs of users.

DETAILED DESCRIPTION

Figure 1:
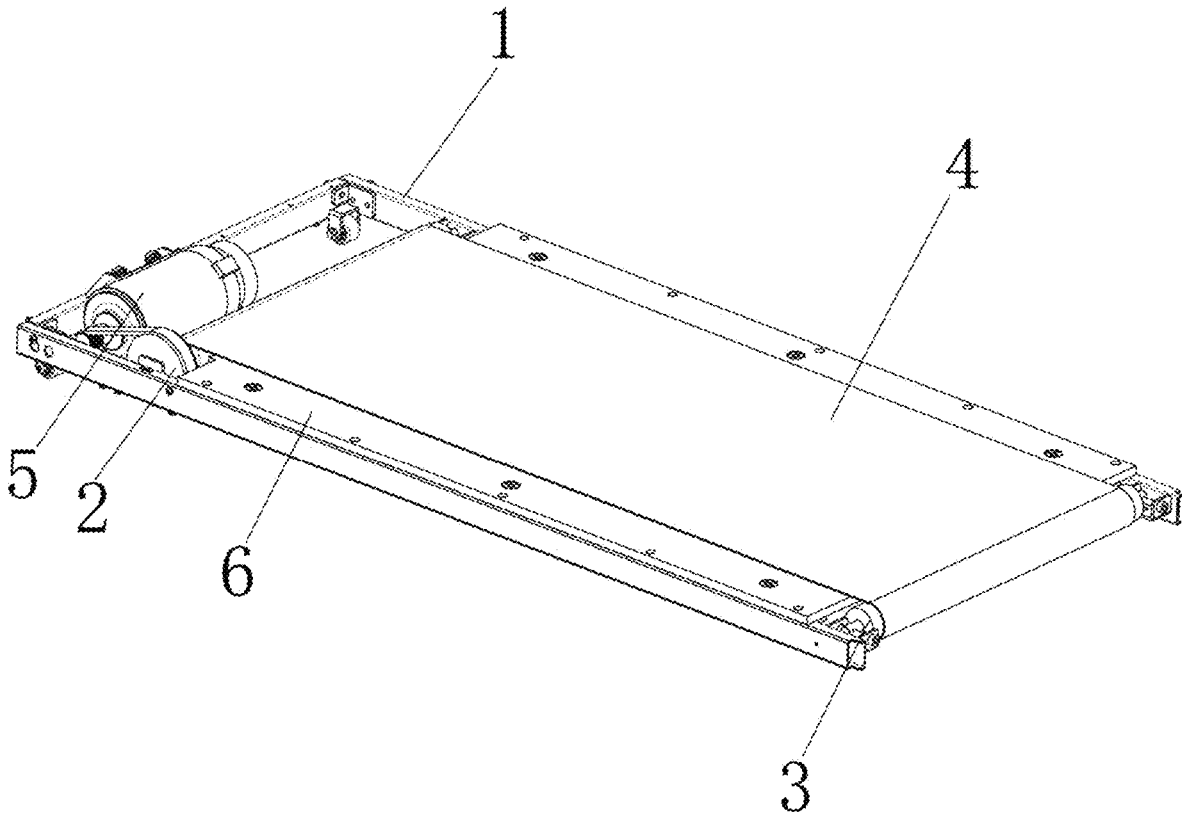
FIG. 1 is a schematic diagram of a first movement side according to the present application.

The present application will be further described in detail below by reference to the accompanying drawings and embodiments.

Referring to FIGS. 1-4, a double-sided treadmill includes a frame 1, and the frame 1 is a frame structure on a treadmill and can be formed by assembling metal members. A driving roller 2 is rotatably arranged at a position, close to a front, of the frame 1, a driven roller 3 is rotatably arranged at a position, close to a rear, of the frame 1, and a running belt 4 is wound around the driving roller 2 and the driven roller 3. At the same time, a motor 5 is arranged at a front end of the frame 1, the motor 5 is connected to the driving roller 2 in a driving manner, and the motor 5 after being started can drive the driving roller 2 to rotate, thus driving the running belt 4 to perform cycle movement.

The driving fit between the motor 5 and the driving roller 2 can be referred to existing designs, such as a belt drive.

Figure 2:
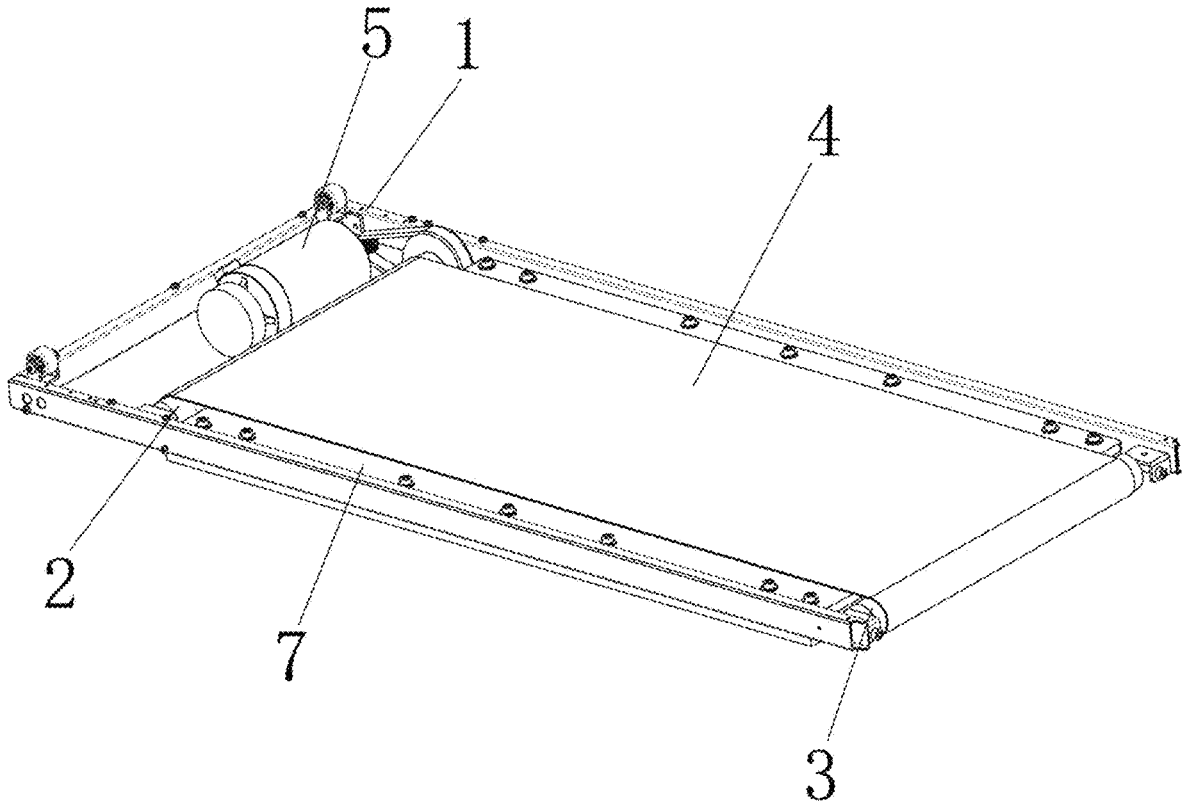
FIG. 2 is a schematic diagram of a second movement side according to the present application.

In this example, a first running plate 6 and a second running plate 7 are further arranged on the frame 1. Both the first running late 6 and the second running plate 7 are surrounded by the running belt 4 in a winding manner, as shown in FIGS. 1 and 2, whether the treadmill is in a front or back side state, the running belt 4 is located outermost, and the corresponding running plate is located below the running belt, and the first running plate 6 and the second running plate 7 mainly serve for supporting.

When in the front side state, the treadmill has a first movement side; and when in the back side state, the treadmill has a second movement side.

It is to be noted that if only one thicker running plate is arranged on the frame 1, it is possible to consider a front side of the running plate as the first running plate and a back side as the second running plate.

When two running plates are arranged on the frame 1, a gap can be left between the two running plates, and a transverse bar fixedly arranged on the frame can be arranged at the gap, to fill in and strengthen the support effect of the running plates or facilitate the fixing of the running plates.

In this example, the first running plate 6 is a running plate without a massage function, and the second running plate 7 is a running plate with a massage function. For the second running plate 7, a massage unit is arranged thereon for massage, and the massage unit has at least two forms as follows.

Figure 3:
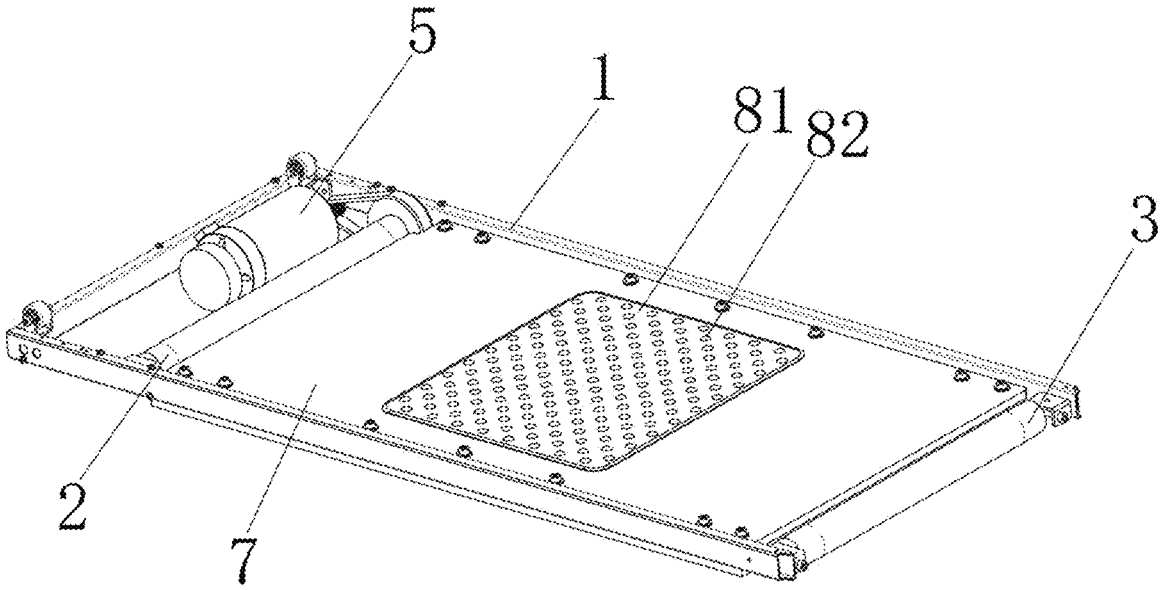
FIG. 3 is a schematic diagram of a first layout of a massage unit according to the present application.

As shown in FIG. 3, one form is shown, in which the massage unit includes a plate member 81 fixedly arranged on the second running plate 7 and a plurality of projections 82 distributed on the plate member 81. In one embodiment, the projections 82 are integrally formed on the plate member 81.

Figure 4:
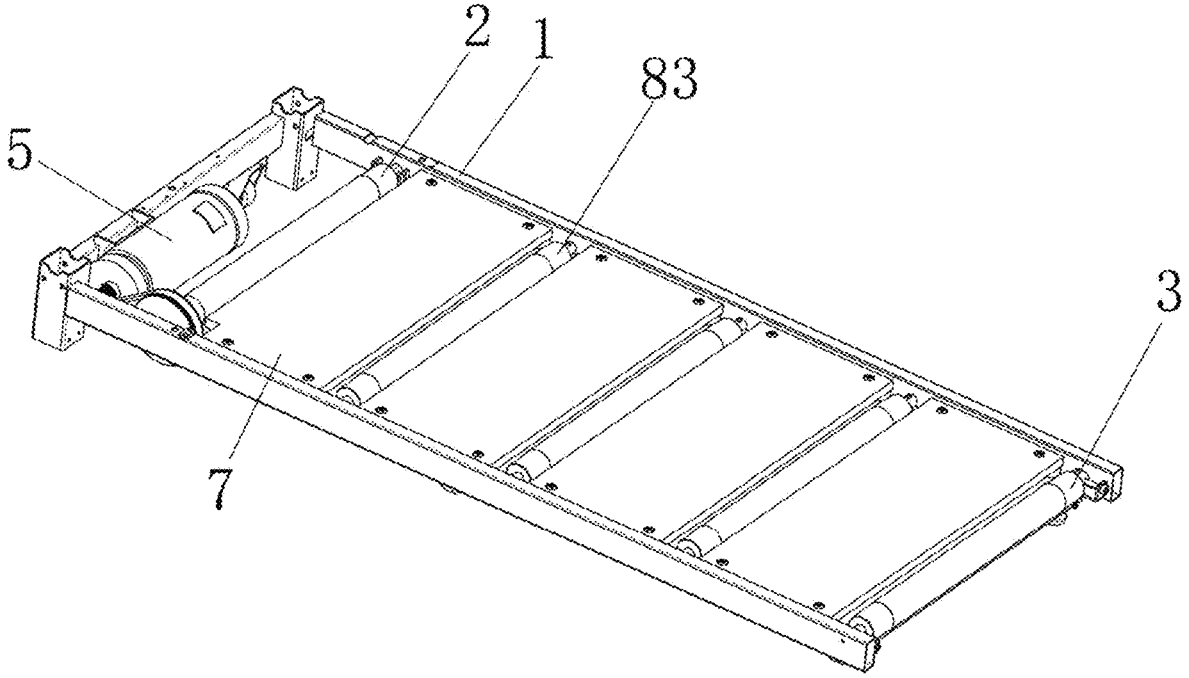
FIG. 4 is a schematic diagram of a second layout of the massage unit according to the present application.

As shown in FIG. 4, another form is shown, in which the massage unit is a roller 83 embedded in the second running plate 7 and rotatably connected to the second running plate 7 or the frame 1. The embedding may be in the form that a recess for accommodating the massage unit is disposed on the second running plate 7 or in the form of dividing the second running plate 7 into a plurality of separate components with gaps left for accommodating the massage unit between adjacent separate components.

When the running belt on the treadmill is in normal use, it is usually in the form of a rearward movement, and after the treadmill is flipped over, if not designed, the running belt 4 will in the form of a forward movement and cannot be used normally. For this reason, in this example, a control unit is further arranged on the frame 1 or on a component mounted on the frame 1 to serve for identifying front and back side states of the treadmill and for controlling forward and reverse rotation of the motor.

The control unit includes a controller electrically connected to the motor and a first switch and a second switch electrically connected to the controller, the first switch being configured to identify the front and back side states of the treadmill, and the second switch being configured to control the forward and reverse rotation of the motor.

Alternatively, the first switch is a mercury switch or a gyroscope, and the second switch is a reversing switch.

After a user flips the treadmill over, the first switch identifies a flipping signal and feeds the flipping signal back to the controller, the controller controls the motor to switch between forward rotation and reverse rotation via the second switch, thereby ensuring that whether the treadmill is in the front side state or the back side state, the running belt is able to move in a direction suitable for use by the user.

The examples as described above are merely used for illustrating the technical solutions of the present application, rather than limiting the present application. Although the present application is described in detail by reference to the foregoing examples, it is to be understood by those ordinary skilled in the art that the technical solution set forth in each example can still be modified or some technical features can be replaced equivalently, and those modifications or equivalent replacements cannot make the modified technical solution out of the spirit and scope of the technical solution of the present application.

The invention claimed is:

1. A double-sided treadmill, comprising a frame, a driving roller and a driven roller being rotatably arranged on the frame, the driving roller being driven to rotate by a motor arranged on the frame, and a running belt being wound around the driving roller and the driven roller;

a first running plate, arranged on the frame and surrounded by the running belt in a winding manner to serve as a first movement side of a treadmill platform;

a second running plate, arranged on the frame and surrounded by the running belt in a winding manner to serve as a second movement side of the treadmill platform; and a control unit, arranged on the frame or on a component mounted on the frame to serve for identifying front and back side states of a treadmill and for controlling forward and reverse rotation of the motor, the control unit controlling the motor to change a driving direction when the treadmill is flipped over, to keep the running belt always moving in a rearward direction of the treadmill.

2. The double-sided treadmill according to claim 1, wherein the control unit comprises a controller electrically connected to the motor and a first switch and a second switch electrically connected to the controller, the first switch being configured to identify the front and back side states of the treadmill, and the second switch being configured to control the forward and reverse rotation of the motor.

3. The double-sided treadmill according to claim 2, wherein the first switch is a mercury switch or a gyroscope, and the second switch is a reversing switch.

4. The double-sided treadmill according to claim 1, wherein a gap is left between the first running plate and the second running plate.

5. The double-sided treadmill according to claim 4, wherein a transverse rod fixedly arranged on the frame is arranged at the gap.

6. The double-sided treadmill according to claim 1, wherein both the first running plate and the second running plate are fixedly arranged on the frame.

7. The double-sided treadmill according to claim 1, wherein a massage unit for massage is arranged on the second running plate.

8. The double-sided treadmill according to claim 7, wherein the massage unit comprises a plate member fixedly arranged on the second running plate and a plurality of projections distributed on the plate member.

9. The double-sided treadmill according to claim 8, wherein the projections are integrally formed on the plate member.

10. The double-sided treadmill according to claim 7, wherein the massage unit is a roller embedded in the second running plate and rotatably connected to the second running plate or the frame.

* * * * *